United States Patent [19]

Slagle

[11] 4,180,260

[45] Dec. 25, 1979

[54] EXERCISE DEVICE

[76] Inventor: Fred Slagle, 1701 Mentor Ave., Painesville, Ohio 44077

[21] Appl. No.: 835,803

[22] Filed: Sep. 22, 1977

[51] Int. Cl.[2] ..... A63B 69/18

[52] U.S. Cl. ..... 272/97; 172/145

[58] Field of Search ..... 272/97, 145, 55.5 SS, 272/56, 144; 46/147, 16, 17; 403/121, 256, 346, 347

[56] References Cited

U.S. PATENT DOCUMENTS

| | | | |
|---|---|---|---|
| D. 194,515 | 2/1963 | Dawson | 46/16 |
| 1,752,110 | 3/1930 | Remy | 272/144 |
| 2,455,274 | 11/1948 | Scriver | 272/97 |
| 2,658,754 | 11/1953 | Courtney | 272/145 |
| 2,855,198 | 10/1958 | King | 272/145 X |
| 3,582,066 | 6/1971 | Keryluk | 272/97 |
| 3,708,163 | 1/1973 | Hynes | 272/97 |

*Primary Examiner*—Richard J. Johnson
*Attorney, Agent, or Firm*—William N. Hogg

[57] ABSTRACT

An exercise device is provided which simulates the action of skiing for training and developing the muscles used in skiing. The device includes a leg having at least one aperture into which a round peg is inserted. A board is provided which has a slot which fits over the leg and rests on the peg. The end of the board is pivotally rested on the floor. Straps are provided to hold the user's feet. The board wll rock back and forth in a limited manner when user is on it, simulating a ski action. Several apertures may be provided to change the position of the peg and hence the action of the board.

4 Claims, 3 Drawing Figures

EXERCISE DEVICE

BACKGROUND OF THE INVENTION

This invention relates generally to balance training devices, and more particularly to a balance training board and leg structure especially adapted for use as a device for developing balancing skills used in skiing.

The acquisition and development of balancing skills is especially necessary in learning and developing the art of skiing. Generally, in the past it has not been practical to develop these special skills except by actually practicing on skis under actual skiing conditions. There have been some prior art suggestions of balance training devices, but these have not closely simulated actual skiing conditions, and hence, have not had great value in providing the necessary balance training for developing the skills necessary for skiing.

SUMMARY OF THE INVENTION

According to the present invention, a balance training device is provided which has a support leg for resting on a surface. The leg has at least one aperture. A balance board is provided with a slot to fit over the support leg. A pin is provided which fits into the aperture and supports one end of the board while the other end of the board rests on the support surface. Foot engaging means, such as straps with a buckle are provided to engage the feet of a user.

DESCRIPTION OF THE PREFERRED EMBODIMENT

Figures 1, 2, 3:
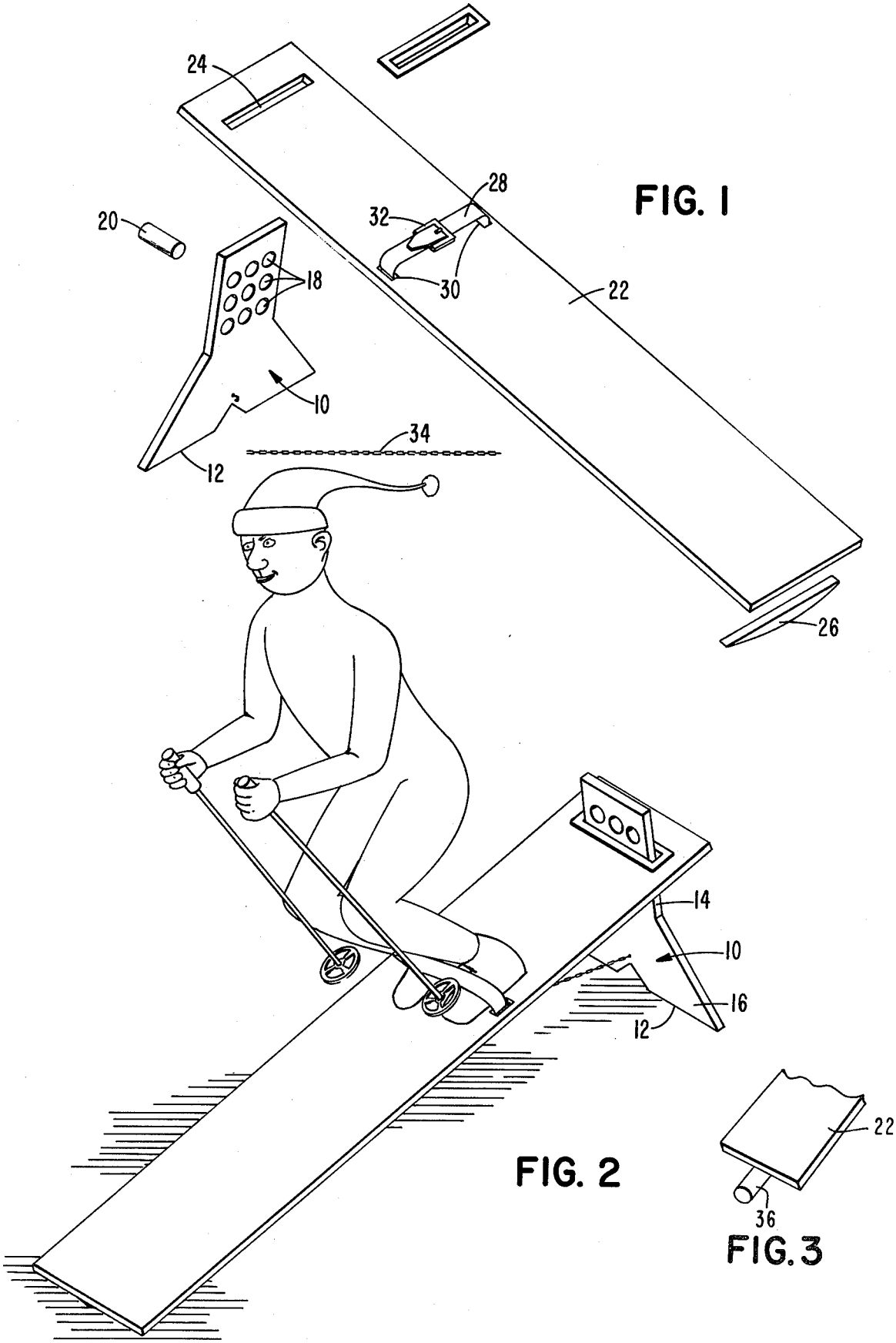
FIG. 1 is an exploded view of the device of the present invention.
FIG. 2 is an assembled view of the device of the present invention showing it in use.
FIG. 3 is a view of an alternative support for the end of the board.

Referring now to the drawing, a balance training device according to this invention is shown. The device is preferably utilized for balance training for skiing, and will be so described, but its use is not specifically limited thereto.

The device includes a support leg 10 having one flat end 12 configured to rest firmly on a support surface, such as the floor of a room, or any other flat surface. The leg 10 has a narrow upper portion 14, and a flared lower portion 16, terminating at the flat end 12. The upper portion 14 of the leg 10 is provided with a series of aperture 18 passing therethrough, the aperture being adapted to removably receive a support peg 20. The peg 20 is configured to fit snugly into each aperture so that it will not easily drop out, but not so tightly that it cannot be readily removed for adjustment of the board, as will be described presently.

A balance board 22 is provided, which is a flat board generally about five to seven feet long. The board 22 has a slot 24 formed near one end thereof, which is configured to fit over the top portion 14 of the leg 10. The length of the slot is somewhat longer than the width of the upper portion 14 of the leg 10. The opposite end of the board 22 has a rounded, or other non-flat support or pivot member 26 on the lower side thereof, adapted to support that end of the board on a surface for a side-to-side rocking movement. Alternatively this pivot member 26 may be formed as a separate element as shown in FIGS. 3; such as a cylindrical pin 36 which can be removably positioned under the end of the board to provide the required rocking or pivoting movement of the board.

The board 22 is assembled onto the leg 10 by placing the slot over the top portion 14 of the leg 10 and selecting the desired aperture for the peg 20, and inserting the peg 20 therein, extending from the aperture and then resting the board thereon. The pivot member 26 of the board will rest on the support surface. The board, as thus supported, is free to pivot laterally to a limited extent depending upon the relative size of the slot 24 and width of the upper portion 14 of the leg 10 and the configuration of the pivot member 26. The choice of the positioning of the peg 20 will be described presently.

The board 22 is provided with foot engaging means in the form of a strap 28, passing through openings 30 in the board and having a buckle 32 disposed to tighten the strap over the feet of a user of the device to secure him thereon as shown in FIG. 2. A safety chain 34 is secured at one end to the leg 10 and at the other end to the underside of the board 22 to prevent inadvertent collapse of the device when in use.

OPERATION

To use the device, it is assembled as shown, with the board 22 supported on the peg 20 in one of the aperture 18. The user straps his feet to the board with the strap 28, and thus is in a position which simulates "heading down hill." The steepness of the "hill" is controlled by the angle of the board which in turn depends on how high an aperture 18 is chosen for the peg 20. The action of the board on the peg 20 and pivot member 26 tends to cause the board to pivot laterally, the board being unstable laterally because of this type of support. This lateral pivoting can be controlled by the user in a way which allows the user to exercise the various movements, or techniques utilized for making various turns on skis. The slope of the board, or course, simulates the downhill posture during skiing.

Further, by changing the lateral position of the peg, an unbalanced-left, or unbalanced-right condition may be created, which will tend to favor one leg or the other.

Hence, by using the balance device of this invention, thus a person, in a short period of time, can improve his skiing techniques.

What is claimed is:

1. A balance training device for a skier comprising a support leg configured to rest on a support surface, a balance board, means to support one end portion of said balance board on said support leg above said support surface at a plurality of positions thereon, with the other end on the support surface permitting limited lateral rocking motion of the board with respect to said support leg and the support surface, said means including a through slot formed in said one end portion of the board configured to slide over said leg, and peg means to support the board on said leg, said leg including a plurality of holes arranged for different vertical and horizontal positions of said peg means with respect to said board, and said peg means removably replaceable in said holes to vary the position of support of said board, means to interconnect said board and said leg to prevent collapse, and foot engaging means on said board.

2. The invention, as defined in claim 1, further characterized by pivot means on said other end of said board for engagement on said support surface.

3. The invention, as defined in claim 2, wherein Said pivot means includes a separate cylinder.

4. The invention, as defined in claim 1, wherein said foot engaging means includes strap means to secure feet to the board.

* * * * *